US006428001B1

(12) United States Patent
Jackson

(10) Patent No.: US 6,428,001 B1
(45) Date of Patent: Aug. 6, 2002

(54) SIGNATURE SLOWDOWN APPARATUS

(75) Inventor: Barry Mark Jackson, York, ME (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/539,578

(22) Filed: Mar. 31, 2000

(51) Int. Cl.[7] ..... B65H 5/16
(52) U.S. Cl. ..... 271/270; 270/182
(58) Field of Search ..... 271/270, 182

(56) References Cited

U.S. PATENT DOCUMENTS

| | | | | |
|---|---|---|---|---|
| 2,084,783 A | * | 6/1937 | Seybold | |
| 3,830,355 A | * | 8/1974 | Verjux | |
| 4,506,873 A | | 3/1985 | Faltin | |
| 5,803,450 A | | 9/1998 | Brokate et al. | |
| 6,302,391 B1 | * | 10/2001 | Francois | 271/182 |

FOREIGN PATENT DOCUMENTS

| | | | |
|---|---|---|---|
| DE | 19831044 | 1/2000 | B65H/29/68 |
| EP | 0972733 A2 * | 1/2000 | |

OTHER PUBLICATIONS

U.S. Patent application Ser. No. 09/352,251 filed Jul. 13, 1999.

* cited by examiner

*Primary Examiner*—Christopher P. Ellis
*Assistant Examiner*—Richard Ridley
(74) *Attorney, Agent, or Firm*—Davidson, Davidson & Kappel, LLC

(57) ABSTRACT

A signature slow down device is provided which includes an entrance nip mechanism for receiving a signature from an upstream device at a first signature transport velocity and reducing the transport velocity of the signature to a first reduced transport velocity; and an exit nip mechanism for receiving the signature from the entrance nip mechanism, and further reducing the transport velocity of the signature to a second reduced transport velocity. In accordance with the present invention, the respective signature contacting surfaces of the entrance and exit nip mechanisms are each defined by a pair of opposing non-circular rotating components. Each non-circular rotating component has a first surface portion for forming a nip with its opposing non-circular rotating component and a second surface portion for forming a gap with its opposing non-circular rotating component. In each of the entrance and exit nip mechanisms, the opposing non-circular rotating components rotate at a variable velocity profile in which the non-circular rotating components decelerate when the nip is formed, and accelerate with the gap is formed.

21 Claims, 14 Drawing Sheets

SIGNATURE SLOWDOWN APPARATUS

FIELD OF THE INVENTION

The present invention relates to the field of signature slow down devices.

BACKGROUND OF THE INVENTION

Web printing presses print a continuous web of material, such as paper. The continuous web then is cut in a cutting unit so as to form signatures that can then be folded in a folder or arranged in different manners.

Conventional quarter folders, often referred to in the art to as choppers, have an inherent speed limitation. In this regard, current technology limits the press speed to approximately 55,000 copies per hour. Moreover, to achieve even 55,000 copies per hour, two choppers typically must be placed in parallel, with consecutive signatures diverted to alternate choppers. To increase the press speed above 55,000 copies per hour, a mechanism typically must be incorporated to change the relative velocity between the press speed and the quarter folders.

Combination folders produce multiple product sizes through a series of successive folds that follow the same path through a folder. They are identified as the former old (first fold), jaw fold (second fold), digest and delta (third fold), and quarter fold (fourth fold). The product length can vary from approximately 50% to 25% of the cutoff with no lap and slightly more with lap. To accommodate this varying product length, the slow down mechanism must be flexible to have the same exit speed for all products. If not, then the folder would be forced to have a variable transmission downstream of the slow down mechanism, or the different length products would be required to travel to the delivery in alternate paths. Prior art slow down devices have generally used cylinders to slow down the signatures prior to entry into a quarter-folder or a combination folder.

U.S. Pat. No. 5,803,450 ("450 patent") purports to describe a device for conveying flat floppy products (such as a signature) which includes an inlet conveyor belt with a constant velocity, an intermediate conveyor belt with a periodically changing velocity, and an outlet conveyor belt with constant velocity. The intermediate conveyor belt causes a deceleration or acceleration of the product to be conveyed. Transfer of the product between the conveyor belts takes place at respectively the same velocities of the affected belts. The drive of the intermediate conveyor belt is performed by a gear making periodic gear changes.

U.S. Pat. No. 4,506,873 ("873 patent") purports to describe a high speed cross or quarter folding system for use with high speed signature transport conveyors of web printing presses. The higher speed is purportedly obtained by braking means for gradually slowing down the signature, non-linearly, as it enters the folding station, thereby allegedly preventing damage to the product or erratic folding caused by high speed impact with the fixed stop in the folder. Moving slow down stops are purportedly provided by a cyclically moving timing belt to intercept a paper product moved there into at higher speed by a conveyor. This moving stop is synchronously timed to intercept the paper product moving at a highest transit speed and is non-linearly moved to slow the paper product down to a lowest speed before it engages the fixed stop for folding. Typically a set of elliptical gears provides the non-linear timing belt slow down stop speed ratio of four to one and the system reduces the signature impact speed at the fixed stop by at least 60% from the conveyor speed of entry into the folding station.

SUMMARY OF THE INVENTION

As set forth above, prior art devices for slowing down signatures have generally utilized cylinders, which are expensive, and require sensitive make-ready and operator settings. The slow down devices purportedly described in the '450 and '873 patent utilize belts, rather than cylinders, to slow down the signatures. However, these devices require a greater slow down period than conventional cylinders, require make-ready, and require a phasing mechanism for the different length products associated with a combination folder. In addition, the increased slow down period results in higher forces being applied to the drive train and signature, which may cause slipping between the belts.

In accordance with the present invention, a signature slow down device is provided which includes an entrance nip mechanism for receiving a signature from an upstream device at a first signature transport velocity and reducing the transport velocity of the signature to a first reduced transport velocity; and an exit nip mechanism for receiving the signature from the entrance nip mechanism, and further reducing the transport velocity of the signature to a second reduced transport velocity. In accordance with the present invention, the respective signature contacting surfaces of the entrance and exit nip mechanisms are each defined by a pair of opposing non-circular rotating components. Each non-circular rotating component has a first surface portion for forming a nip with its opposing non-circular rotating component and a second surface portion for forming a gap with an opposing non-circular rotating component. In each of the entrance and exit nip mechanisms, the non-circular rotating components rotate at a variable velocity profile in which the non-circular rotating components decelerate when the nip is formed, and accelerate with the gap is formed.

In accordance with a first embodiment of the present invention, the entrance nip mechanism and the exit nip mechanism each include a pair of opposing cylinders, and each cylinder includes a first arc length having a first radius sufficient to form a nip between the opposing cylinders, each cylinder including a second arc length having one or more second radii, the second radii being smaller than the first radius, the second radii being sufficient to form a gap between the opposing cylinders. Preferably, the cylinders of the entrance nip mechanism are spaced apart from the cylinders of the exit nip mechanism by no more than ¼ of the cutoff of a tabloid fold signature so that the slow down device can process delta, tabloid, and digest fold signatures. In addition, the first and second nip mechanisms preferably follow the same velocity profile. In accordance with a further aspect of this embodiment, each cylinder comprises a plurality of axially spaced apart discs.

In accordance with a second embodiment of the present invention, the entrance nip mechanism includes a entrance nip cylinder and the exit nip mechanism includes an exit nip cylinder, wherein each cylinder includes a first cylinder arc length having a first radius and a second cylinder arc length having one or more second radii, the second radii being smaller than the first radius. Most preferably, the first cylinder arc length is circular relative to the axis of rotation of the cylinder, and the second cylinder arc length is elliptical relative to the axis of rotation of the cylinder. In this regard, the arc length is defined as circular if the radius from each point along the circumference of that portion of the cylinder to the axis of rotation is constant, and the arc length is defined as elliptical if the radius from the circumference of that portion of the cylinder to the axis of rotation varies to form an elliptical shape relative to the axis of rotation.

The entrance nip mechanism further includes a first rotating belt supporting element (such as a sprocket or pulley), the exit nip mechanism further includes a second rotating belt supporting element (such as a sprocket or pulley), and a belt is mounted for rotation about the first and second belt supporting elements. The rotating belt supporting elements have a first pitch diameter arc length having the first radius and a second pitch diameter arc length having one or more second radii, the one or more second radii being smaller than the first radius. The distance between the entrance nip cylinder and the exit nip cylinder is smaller than the distance between the first and second rotating belt supporting elements such that the belt supporting elements straddle the nip cylinders. The first radius is sufficient to form a nip between the respective nip cylinder and the belt disposed over it opposing rotating supporting element and second radius is sufficient to form a gap between the respective nip cylinder and the belt disposed over it opposing rotating supporting element. Preferably, the entrance nip cylinder is spaced apart from the exit nip cylinder by no more than ¼ of the cutoff so that the slow down device can process delta, tabloid, and digest fold signatures. In addition, the first and second nip mechanisms preferably follow the same velocity profile and have the same phase relative to the ground. Moreover, the entrance and exit nip cylinders are each preferably comprised of a plurality of axially spaced apart discs, the rotating belt supporting elements are preferably comprised of a corresponding plurality of axially spaced apart elements, and the belt is preferably comprised of a corresponding plurality of axially spaced apart belts.

In accordance with a third embodiment of the present invention, the entrance and exit nip cylinders of the second embodiment are replaced with a second pair of rotating belt supporting elements. In this embodiment, the slow down device can process delta, tabloid, and digest fold signatures without requiring a ¼ cutoff between rotating elements.

BRIEF DESCRIPTION OF THE DRAWINGS

FIG. 12(*b*) is a side view of the pivoting idler roller of FIG. 12(*a*).

DETAILED DESCRIPTION OF THE PREFERRED EMBODIMENTS

Figure 1:
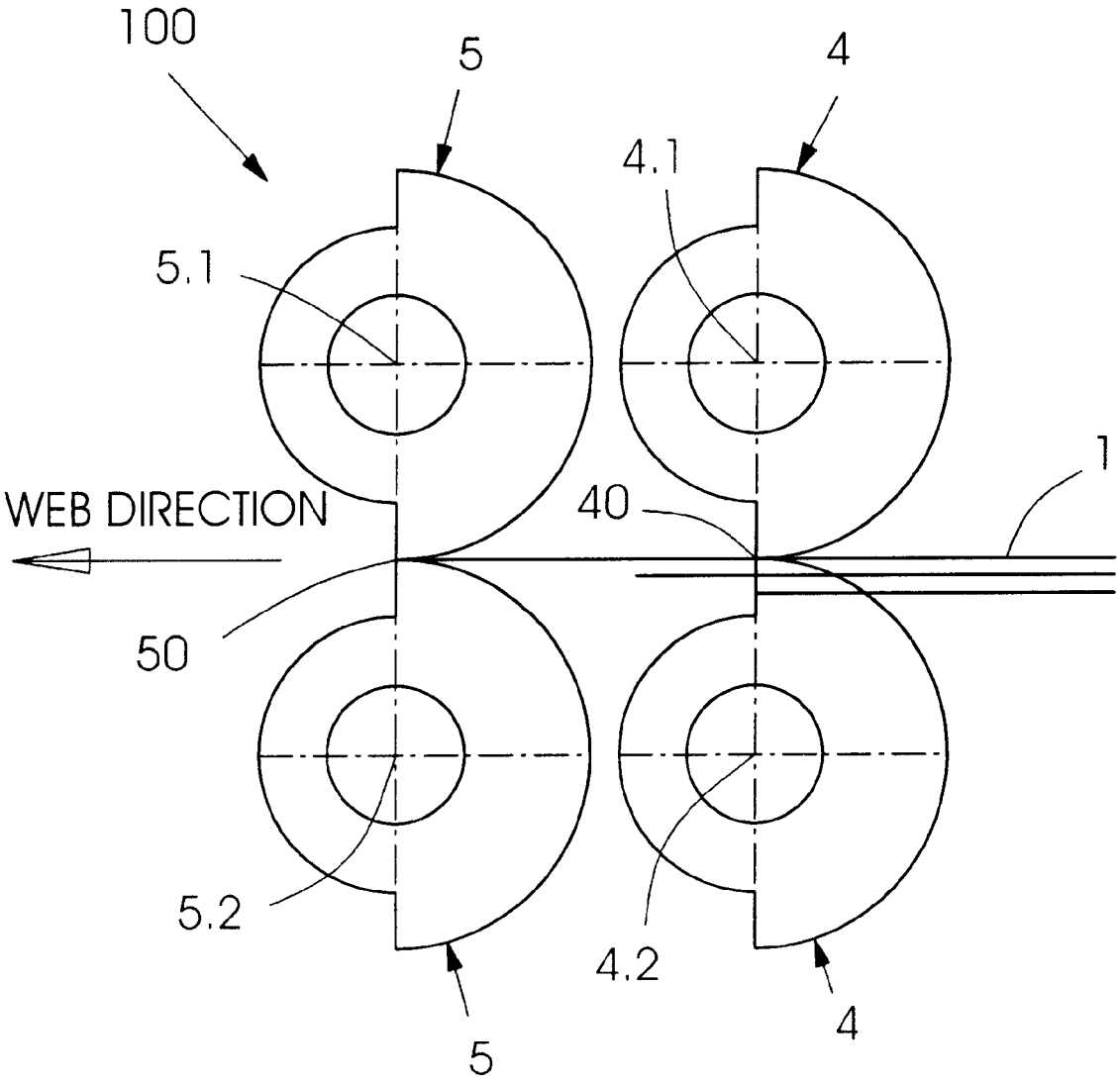
FIG. 1 is a side view of a nip to nip slow down device in accordance with a first embodiment of the present invention.
Figure 3:
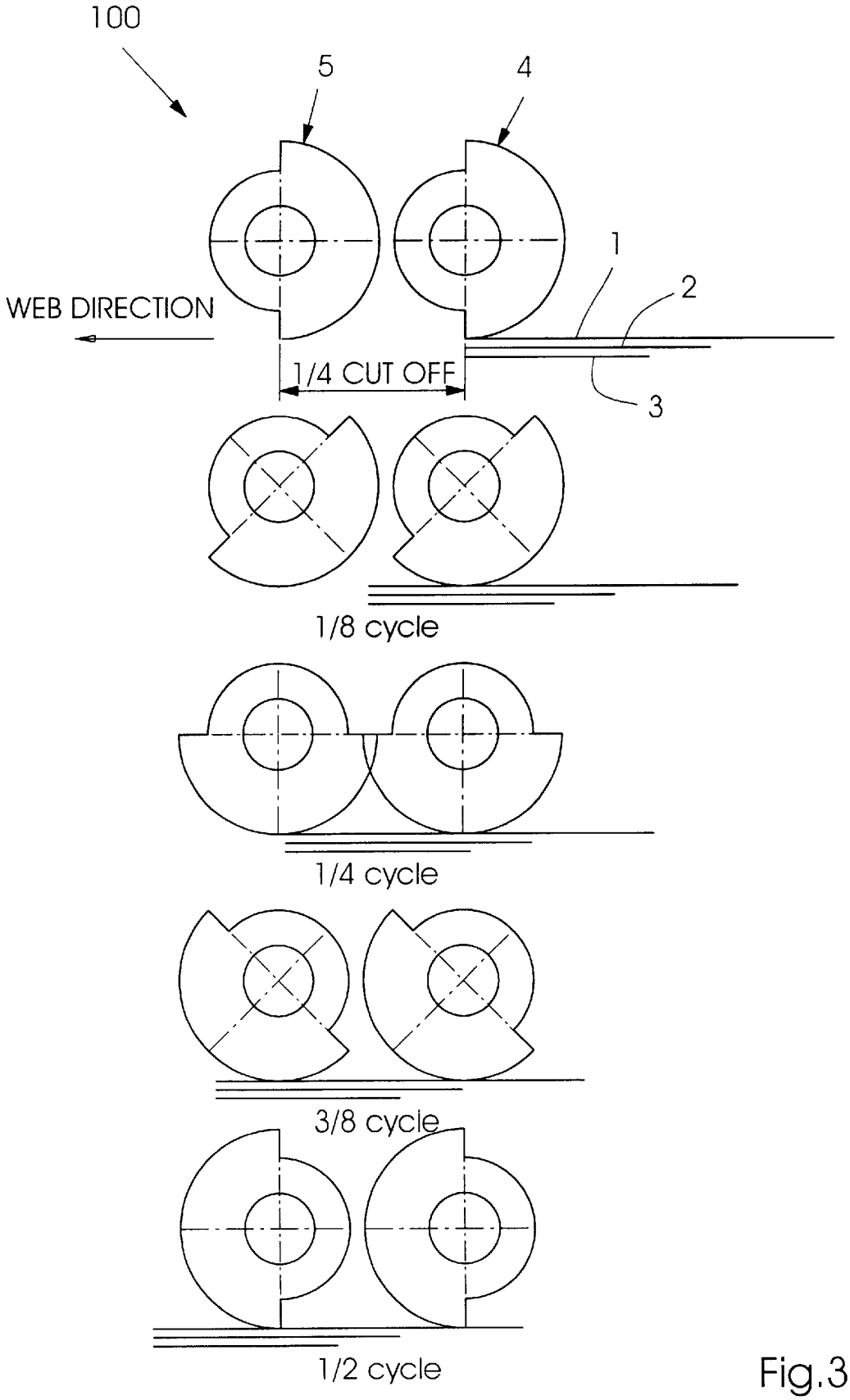
FIG. 3 shows a signature progression of leading edge aligned signatures for the nip to nip slow down device of FIG. 1, with the lower nip discs omitted for ease of illustration.
Figure 5:
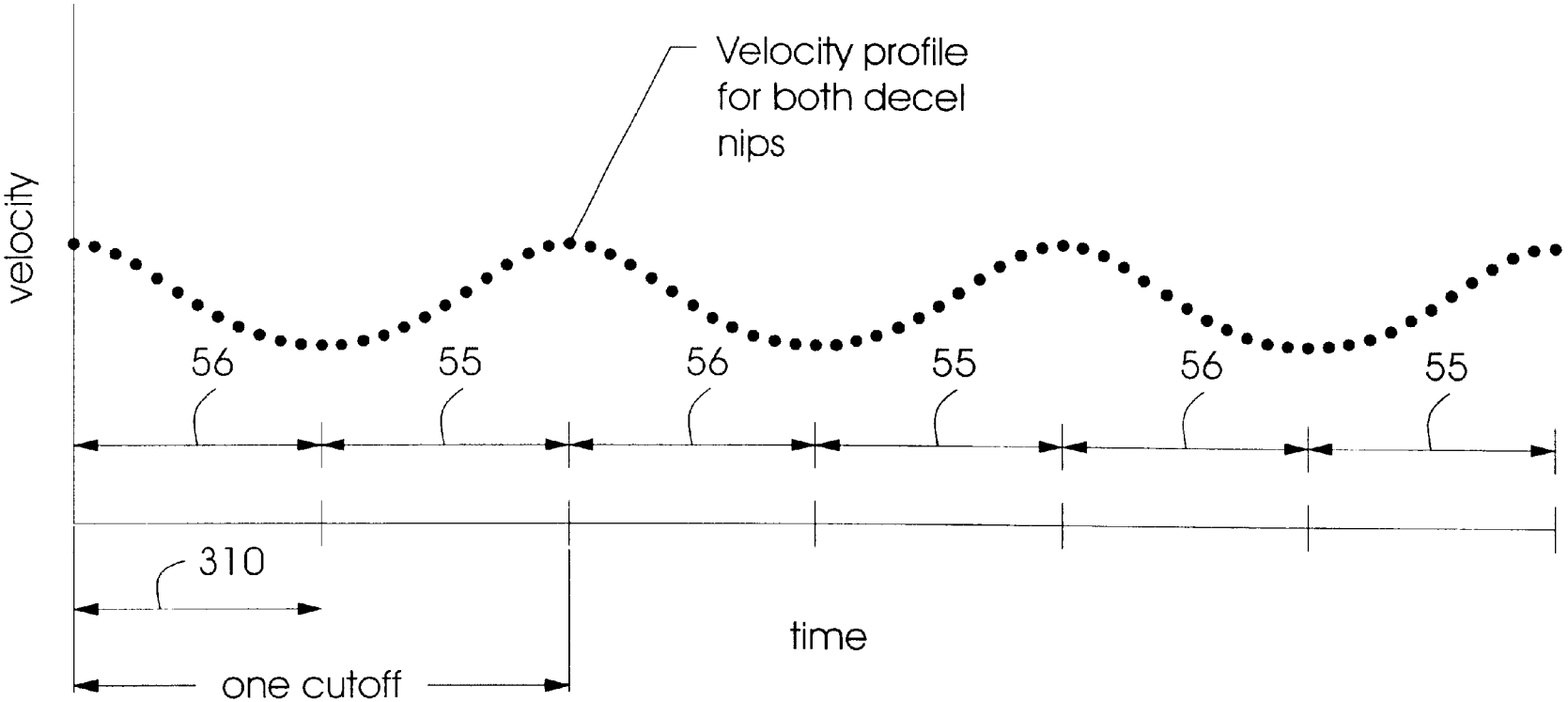
FIG. 5 shows the velocity profile for the double nip slow down devices of FIGS. 1, 6, and 8.
Figure 6:
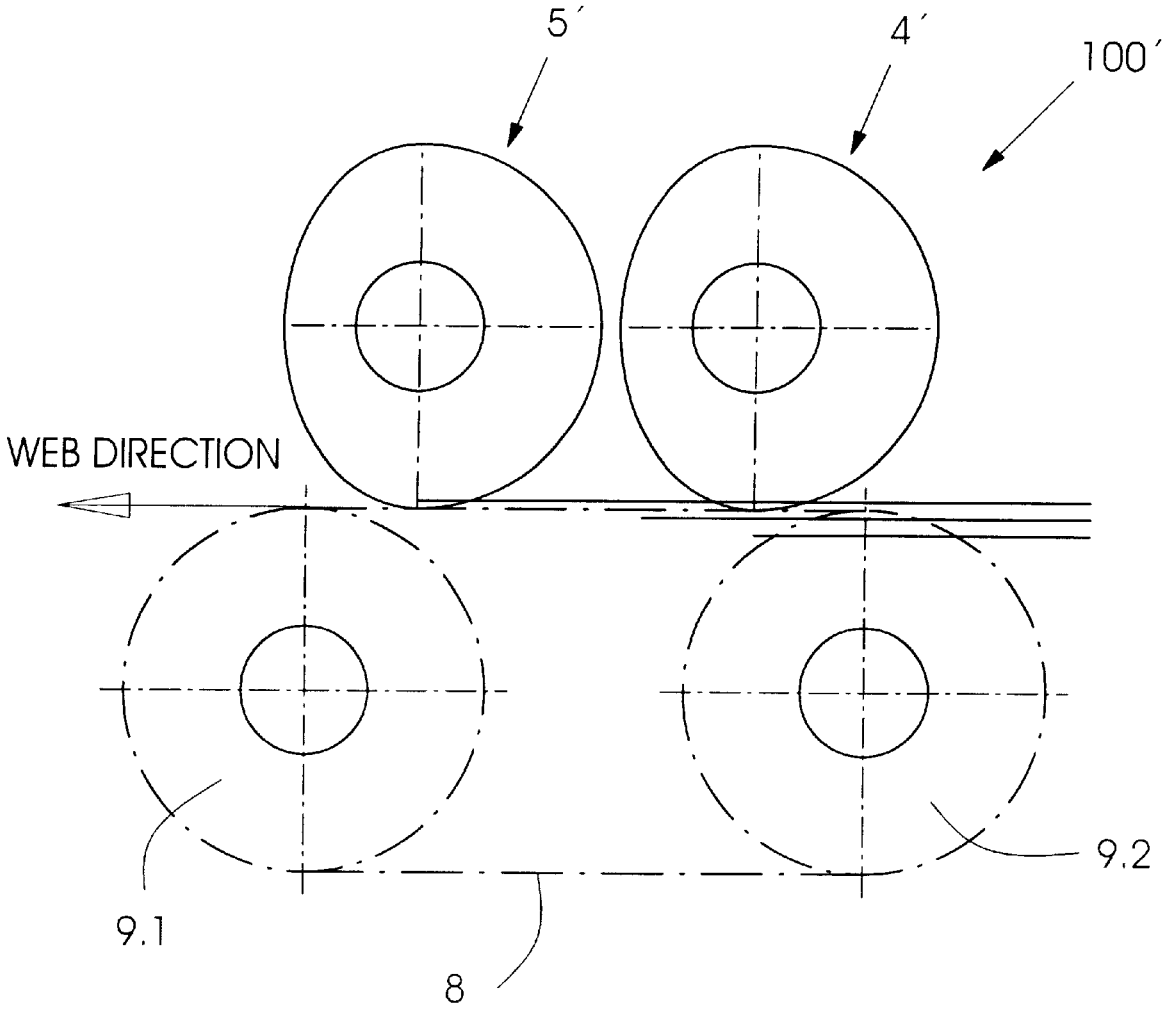
FIG. 6 is a side view of a nip to belt slow down device with aligned upper discs in accordance with a second embodiment of the present invention.
Figure 7:
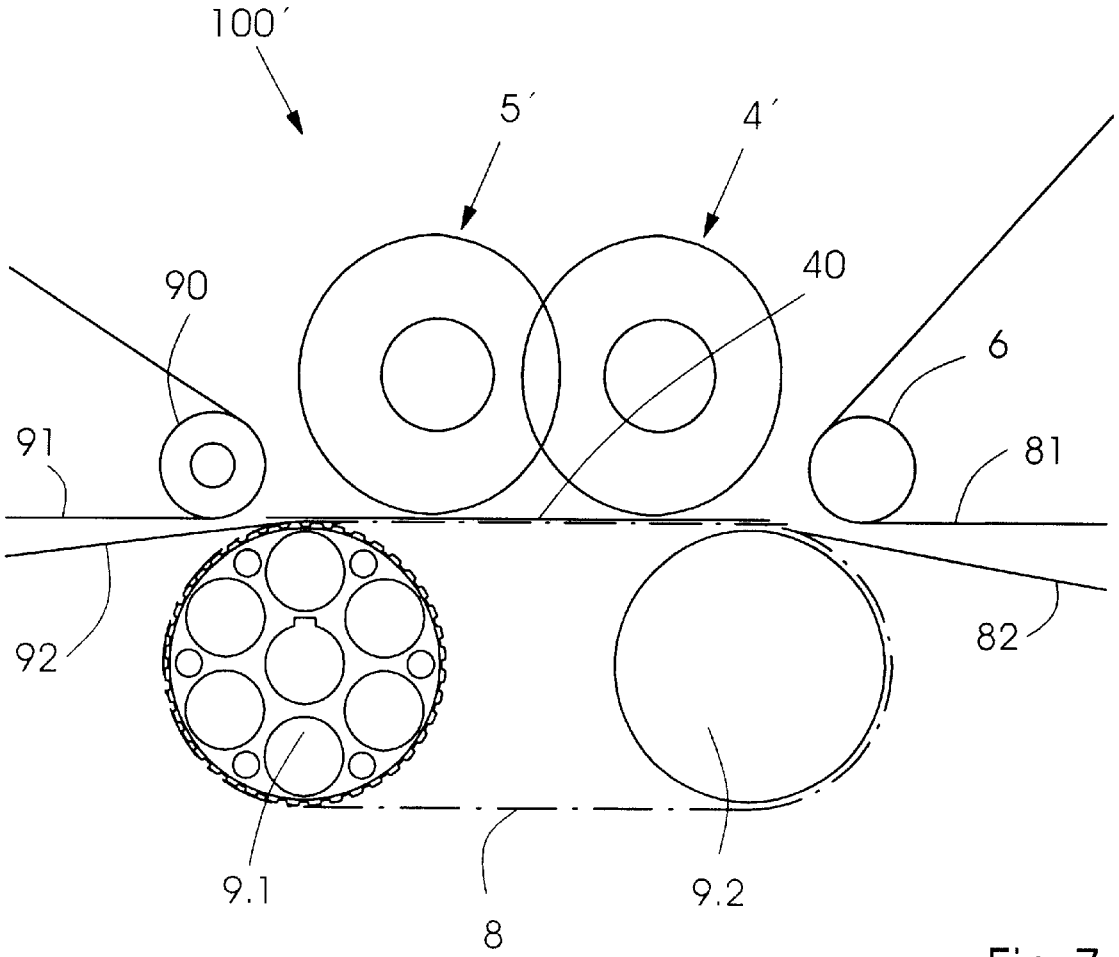
FIG. 7 is a side view of a nip to belt slow down device with offset upper discs in accordance with another aspect of the second embodiment of the present invention.

In accordance with the present invention, a mechanism is provided to slowdown (decelerate) signatures from one series of high-speed transport tapes, to a downstream series of transport tapes having a slower velocity. The signature deceleration is accomplished by a double nip slow down device which exhibits a variable speed profile as indicated in FIG. 5. Three embodiments of the double nip slow down device are described below, each of which can be packaged within the same space. The three double nip slow down devices are: 1) a nip to nip slow down device 100 as shown in FIG. 1; 2) a nip to belt slow down device 100' as shown in FIGS. 6 and 7, and 3) a belt to belt slow down device 100" as shown in FIGS. 8(*a–h*). In each of these embodiments, no operator or make-ready adjustments are required when changing the length of the transported signature. In the case of the nip to belt and belt to belt embodiments, no operator or make-ready adjustments are required when changing the thickness of the transported signature as well.

In accordance with a first embodiment of the present invention, a deceleration device is provided which can decelerate any length product, from tabloid (magazine), delta, to digest, without any re-phasing or make-ready by the operator. In accordance with this embodiment, all of the products take a single path from the fold cylinders to the quarter folder.

FIG. 1 shows a nip to nip slow down device 100 in accordance with a first embodiment of the invention including two sets of axially spaced apart deceleration discs 4 rotating about axes 4.1 and 4.2 to form a leading nip 40 and two sets of axially spaced apart deceleration discs 5 rotating about axes 5.1 and 5.2 to form a lagging nip 50. The discs 4 are spaced apart from the discs 5 at no more than ¼ cutoff. In other words, the distance between axes 4.1 and 5.1 (and between 4.2 and 5.2) is selected so that a ¼ rotation of the discs 4 will move a given portion of a signature from the leading nip 40 to the lagging nip 50. The discs 4 and 5 are driven at the same rotational frequency.

The slow down discs 4, 5 have a "bell" shaped profile. In other words, one half of the circumference the discs has a larger radius than the other half of the circumference, which defines a second surface section which can be any shape. In this regard, the nips 40 and 50 are formed when the opposing larger radius portions of the discs meet.

Figure 2:
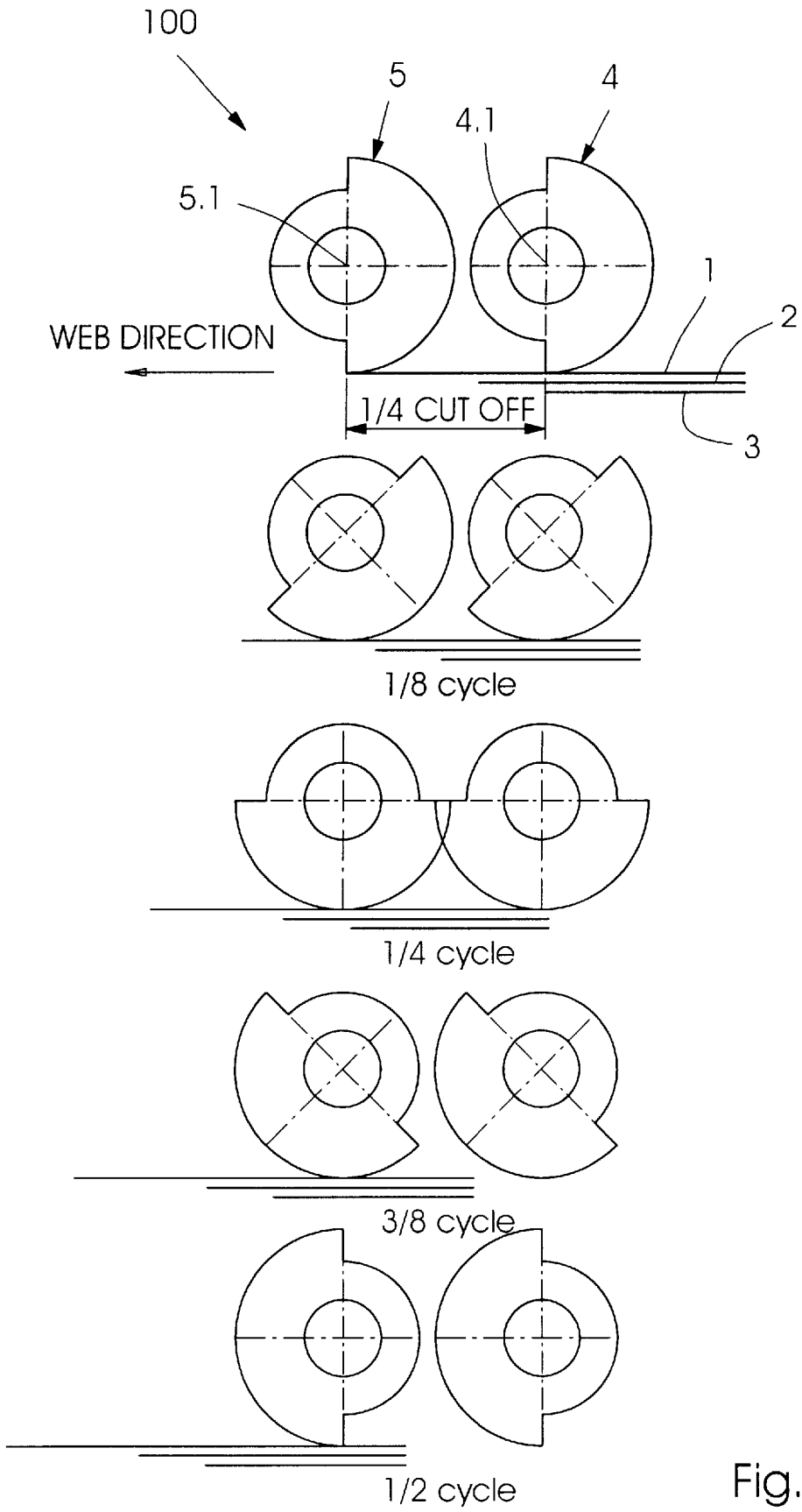
FIG. 2 shows a signature progression of tail edge aligned signatures for the nip to nip slow down device of FIG. 1, with the lower nip discs omitted for ease of illustration.
Figure 4:
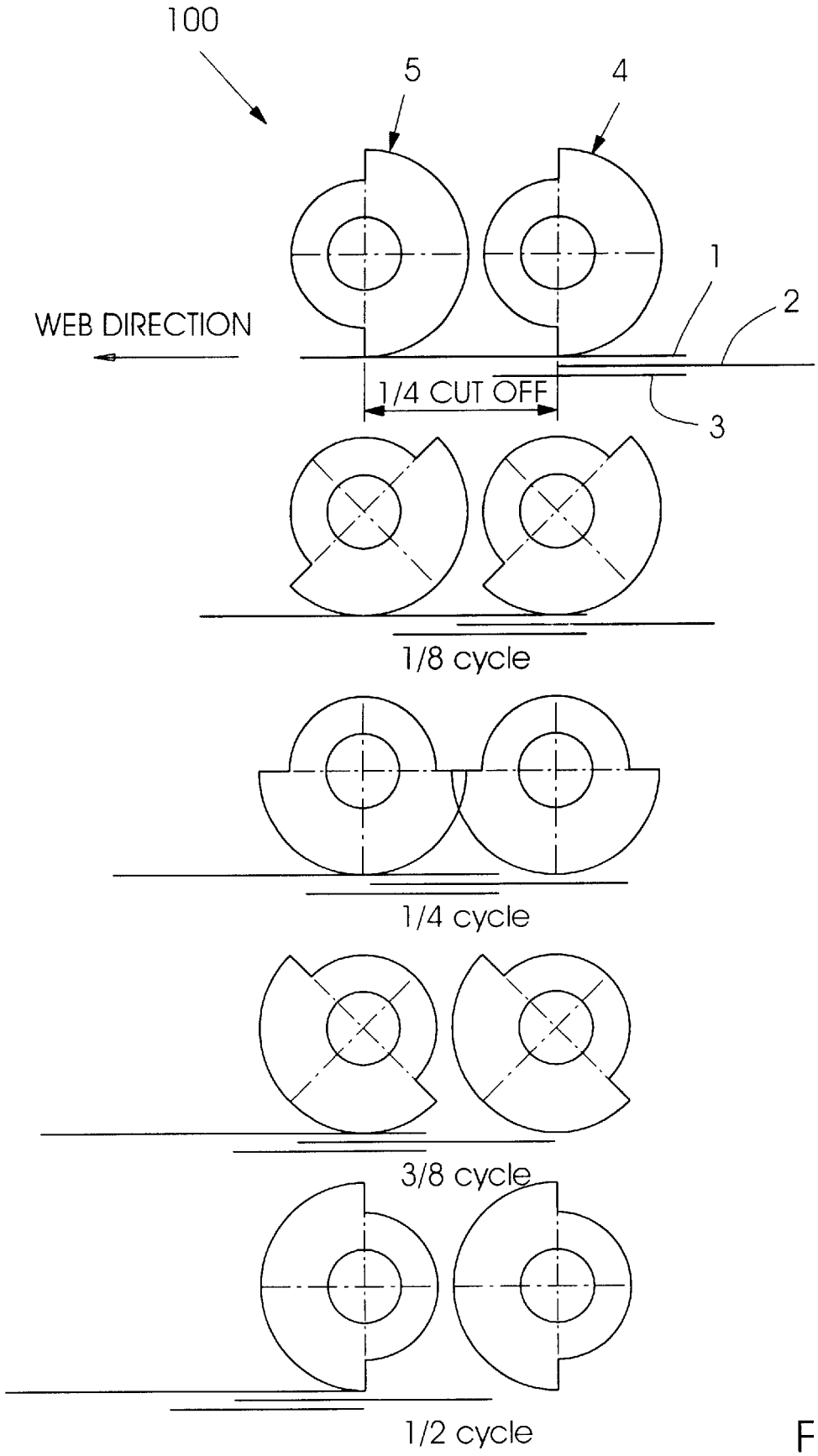
FIG. 4 shows a signature progression of wherein the tucker position varies with the gripper for the nip to nip slow down device of FIG. 1, and illustrates the relative positions of the three folds.

FIG. 2 illustrates the manner in which the nip to nip device 100 slows down signatures 1, 2, and 3, wherein each signature has a different length, and wherein all of the signatures are aligned at their tail ends. FIG. 3 illustrates the manner in which the device 100 slows down signatures 1, 2, and 3, wherein each signature has a different length, and wherein all of the signatures are aligned at their lead ends. FIG. 4 illustrates the manner in which the device 100 slows down signatures 1, 2, and 3, wherein the tucker position varies with the gripper. In FIGS. 2 through 4, signature 1 corresponds to a tabloid fold signature, signature 2 corresponds to a delta fold signature, and signature 3 corresponds a digest fold signature.

FIG. 5 shows the velocity profile for the discs 4 and 5. The velocity profile occurs simultaneously at both slowdown discs 4 and 5. In accordance with this embodiment, the discs 4, 5 rotate at the same phase and same speed relative to the ground. The signature follows the velocity profile of the slow down disc by virtue of the nip 40 or 50 which the signature enters. The velocity profile can be generated by any mechanism, and use any deceleration/acceleration profile, so long as the frequency of rotation has a 1:1 relationship to the cut off of a tabloid fold signature. In other words, one rotation of the nip 40 (or 50) would cause a tabloid fold signature to pass through the nip 40 (or 50) if the discs 4 (or 5) were circular discs having a radius equal to the larger radius of bell shaped discs 4 (or 5). A benefit to extending the deceleration time by using larger discs and a more gradual deceleration profile is that the forces on the system are reduced significantly.

Referring to FIG. 1, a signature 1 enters the first nip with an initial velocity equal to the press speed. The deceleration rate can be any percentage from 0.1% to 50%. For example, if the press speed is 3,000 feet per minute a 50% slowdown will reduce the signature's speed to 1,500 feet per minute when it exits the nip 50.

Referring to FIG. 5, the velocity profile for the discs 4, 5 is comprised of acceleration periods 55 and deceleration periods 56. The larger radius of the discs 4 and 5 phased with the signature so that a signature is engaged by opposing larger radiuses forming respective nips 40 and 50 during deceleration. Then, as the slow down discs accelerate to match the speed of the next incoming signature, a gap forms between the opposing discs so that the acceleration of the discs 4, 5 cannot influence the speed of the signature.

Referring to FIGS. 2 and 3, it should be noted that for signatures 1, 2, and 3 in the configuration of FIG. 2 and for signatures 2 and 3 in the configuration of FIG. 3; the signature departs the leading nip 40 before the nip 40 fully decelerates. Therefore, the exit velocity of these signatures as they exit the nip 40 is not equal to the speed at the exit tapes (not shown). Placing the second slowdown nip 50 downstream in the product direction completes the signature deceleration. For these configurations, it is important that the spacing between nips 40 and 50 is sufficient to allow nip 50 to grip each signature prior to exiting nip 40. In this regard, the spacing between nips is preferably set to one fourth the cut-off to accommodate digest folds, which are the shortest of the three signature lengths. If necessary, the discs 4 may be offset axially relative to discs 5 in order to place the nips more closely together.

Referring to FIG. 2, initial phasing of the discs 4, 5 relative to the signatures is required only for the largest length signature (in this case, the tabloid fold). In this regard, with the discs 4, 5 in the position shown in FIGS. 2(*a*), 3(*a*), and 4(*a*), the leading edge of a tabloid length signature enters the nip 40. Any other length signature would then fall along the two nips. Thus, once an initial phasing for a tabloid fold signature is set, no additional initialization is required for other signature lengths. As one of ordinary skill in the art will appreciate, FIGS. 2, 3, and 4 illustrate that the device 100 works regardless of whether the different signature lengths are leading edge aligned, tail edge aligned, or where the tuck position varies with the gripper.

A nip to belt slow down device 100' in accordance with a second embodiment of the present invention is shown in FIG. 7, with similar components bearing similar reference numerals to FIG. 1. An advantage of this mechanism over the nip to nip mechanism 100 is that no operator or make ready adjustments are required for different product thicknesses. Like the device 100, however, the device 100' does not require phasing for the different product lengths from the different combination folds.

FIG. 7 shows a side view for the nip to belt device 100'. A set of leading discs 4' and lagging discs 5' are offset axially from each other to allow the two sets of discs to be spaced more closely together in an overlapping configuration as shown in FIG. 7. Timing belts 8 rotate about timing belt sprockets (9.1, 9.2) with a respective set of timing belts and sprockets being aligned with each of the discs 4 and 5. The velocity profile of FIG. 5 applies to discs 4' and 5' as well as timing belts 8 and sprockets 9.1, 9.2. As with the device 100 described above, the velocity profile can be generated by any mechanism, so long as the frequency of rotation has a 1:1 relationship to the cut off.

Disc sets 4' and 5' are separated from each other by no more than ¼ of cutoff in the signature transport direction. The sprockets 9.1, 9.2 are positioned outside of, and straddle, the upper discs 4' and 5'. The timing belt sprockets 9.1, 9.2 have a pitch diameter which substantially matches the diameter of the upper nip discs 4', 5'. As a signature 40 enters the nip formed between the discs 4', 5' and the timing belts 8. The "S" wrap formed by the timing belts 8 against the nip discs 4', 5' is a flexible nip, not requiring any presetting for signature of different thickness.

In addition to the advantage of not requiring any alignment for different signature thicknesses, the upper nip discs 4', 5', because of the use of the timing belts, can be designed to a smaller diameter, with an increase in the deceleration rate as compared to the nip-to-nip device 100.

In the device of FIG. 7, a respective timing belt 8 (with corresponding sprockets 9.1, 9.2) is provided for each disc 4' and for each disc 5', because the discs 4', 5' are offset from each other. However, if smaller discs are used (allowing the discs 4' and 5' to be aligned), then a single belt 8 can be provided for each pair of aligned discs 4', 5' as shown in FIG. 6. The size of the discs 4', 5' is dictated by the percentage slow-down desired for the device 100'. Regardless of the slow-down percentage, the spacing between discs 4' and 5' in the signature transport direction does not exceed ¼ of the cutoff.

Preferably, the upper nip discs 4', 5' are of a light weight construction to reduce inertia forces. Most preferably, the discs 4', 5' are primarily made of aluminum. In addition, the back half of each nip disc is shaped as an ellipse. Similar to the reduced diameter portion of the discs 4, 5, the ellipse shaped portion of the discs 4', 5' provide clearance to allow the signature to advance into position with out being influenced by the discs 4', 5' and belt 8 as they accelerate. In addition, the ellipse shaped portion reduces or prevents impulse forces from occurring on the timing belt that would occur from a more discontinuous surface such as the bell shaped discs 4, 5. Naturally, the discs 4', 5' could also be substituted for the discs 4, 5 of the nip to nip device 100 of FIG. 1.

Signature control is maintained for signatures entering the nip-to-belt device 100' via an idler roller 90 with corresponding tapes or belts 91, 92. In this regard, belt 92 rotates freely about the axis 4.2'. The idler roller 90 is positioned with respect to nip between discs 5' and belt 8 to allow the belt 91 to drive the tail edge of the signature into the open throat between the belt 91 and the nip. At the point of impending slow down, about 20 mm of the signature 40 remains in the high-speed transport tapes 91. Any slight speed mismatch between the tapes 91 and the nip is accommodated by allowing the signature 40 to buckle at the gap between the idler roller 90 and the nip.

Signature control is maintained for signatures exiting the device 100' via an idler roller 6 with corresponding belts 81, 82. In this regard, belt 82 rotates freely about the axis 5.2'. The idler roller 6 is positioned to capture the leading edge of the signature 40 by 20 mm before the slowdown disc 4' lifts from the signature 40. Idler roller 6 is attached to a linear slide or an eccentric (no shown) to position idler 6 for the different length products. Preferred embodiments of this positioning mechanism will be discussed in more detail below.

Similar methods of signature control for entering and exiting signatures can also be used for the nip to nip device 100.

Figure 8A:
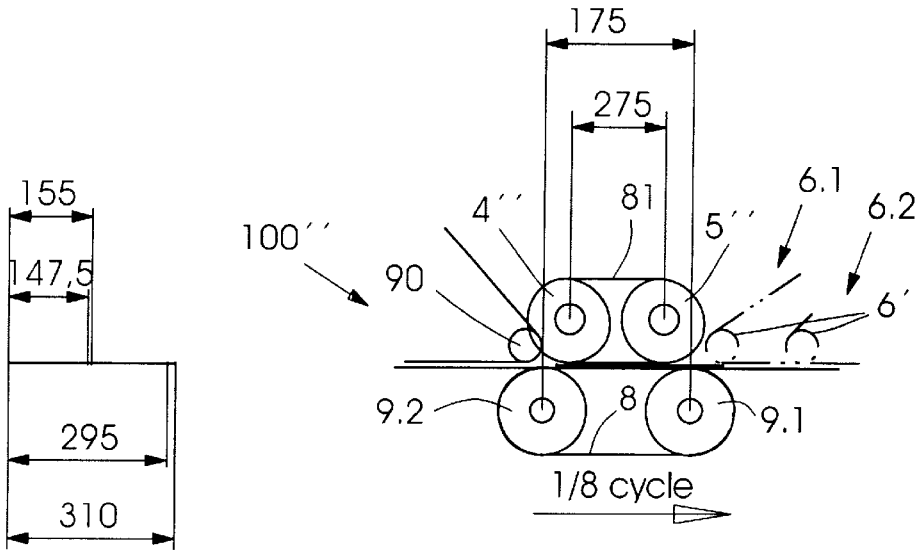
FIGS. 8(*a*) to 8(*h*) show a signature progression of leading edge aligned signatures for a belt to belt slow down device.
Figure 8B:
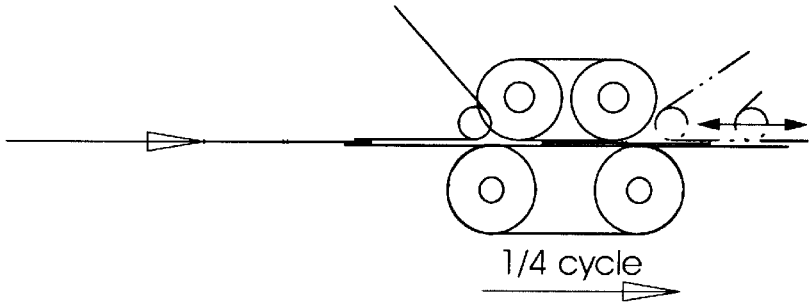
Figure 8C:
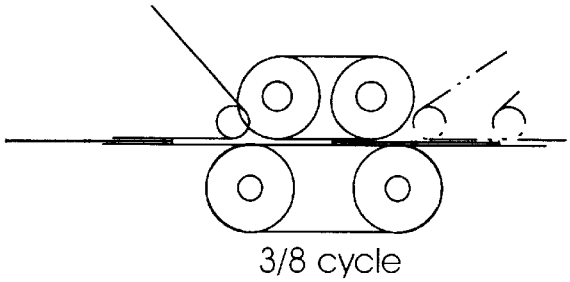
Figure 8D:
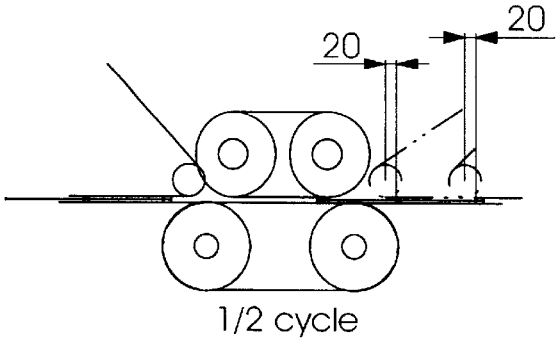
Figure 8E:
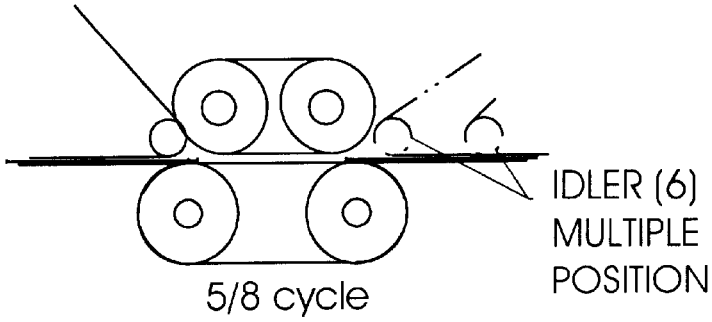
Figure 8F:
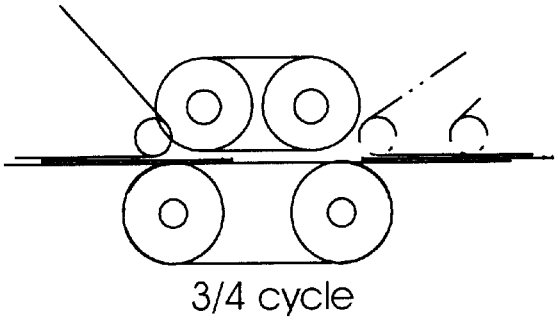
Figure 8G:
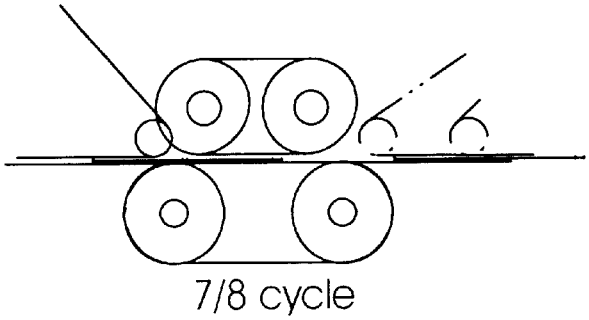
Figure 8H:
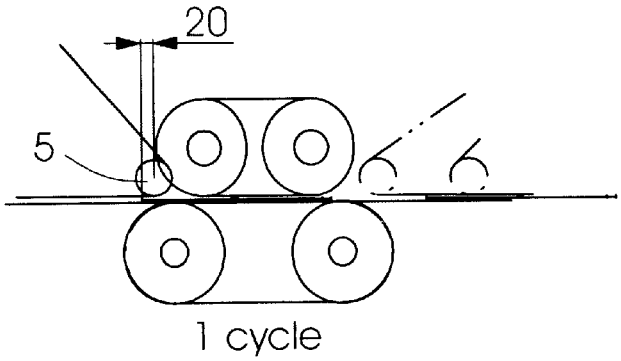
Figure 9A:
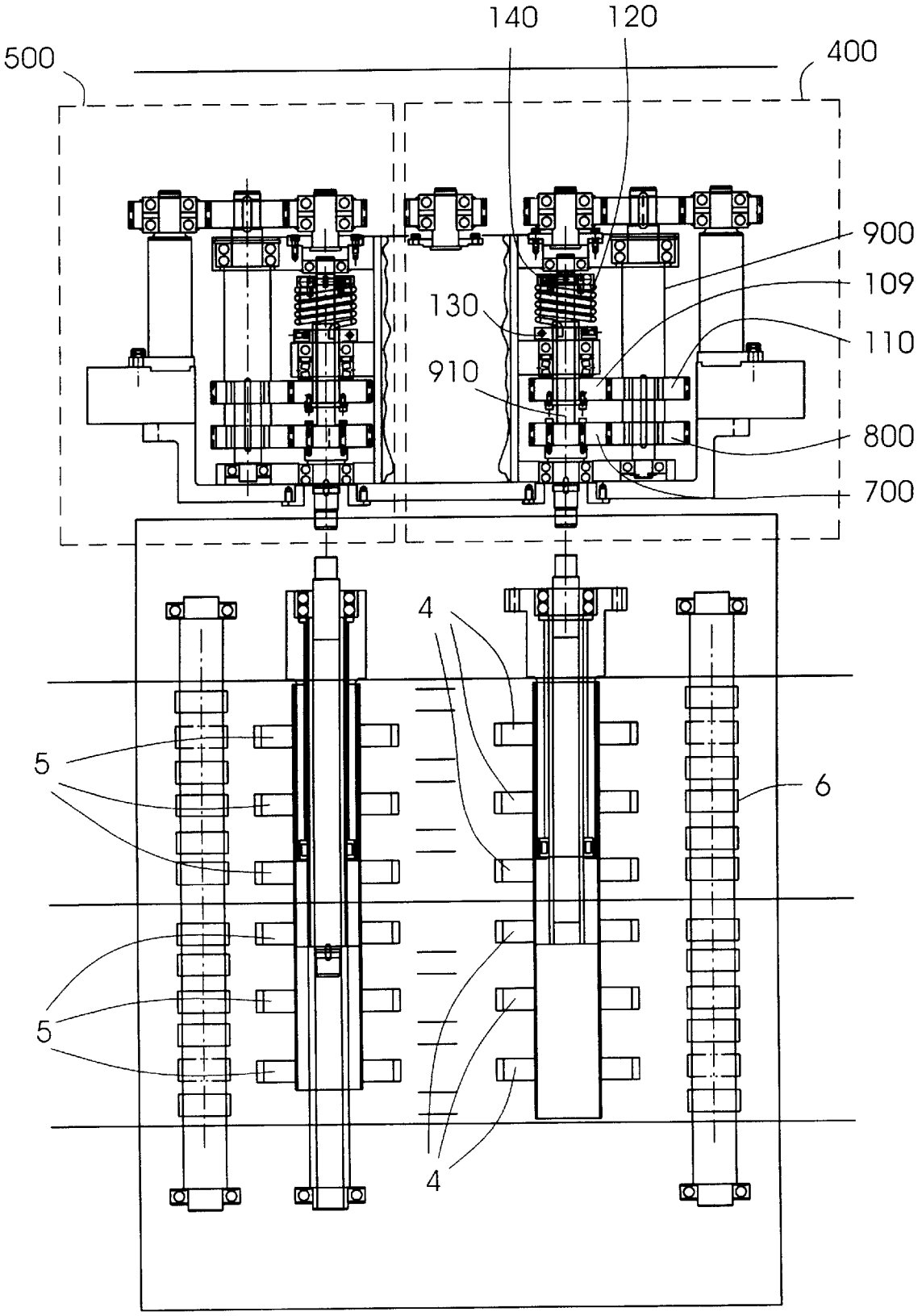
FIG. 9*a* is a top view of the upper disc assembly of the nip to belt slow down device of FIG. 7.
Figure 9C:
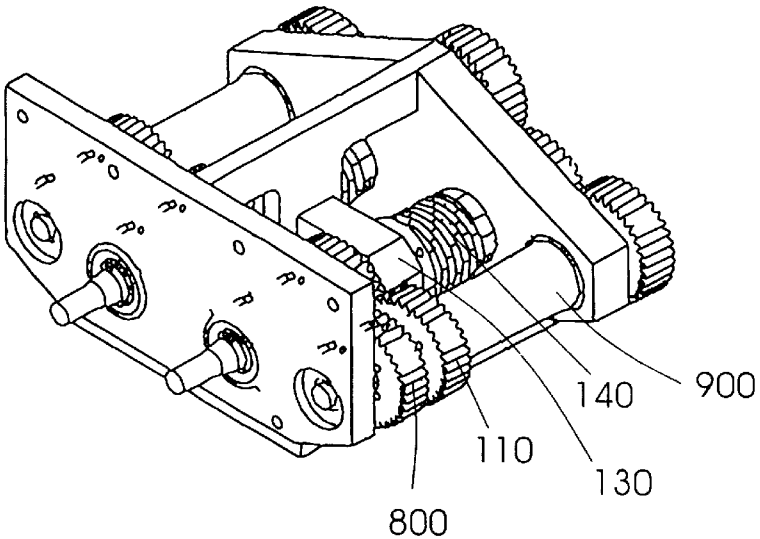
FIGS. 9(*b*), 9(*c*), and 9(*d*) are perspective views of the drive assembly of FIG. 9(*a*).
Figure 9B:
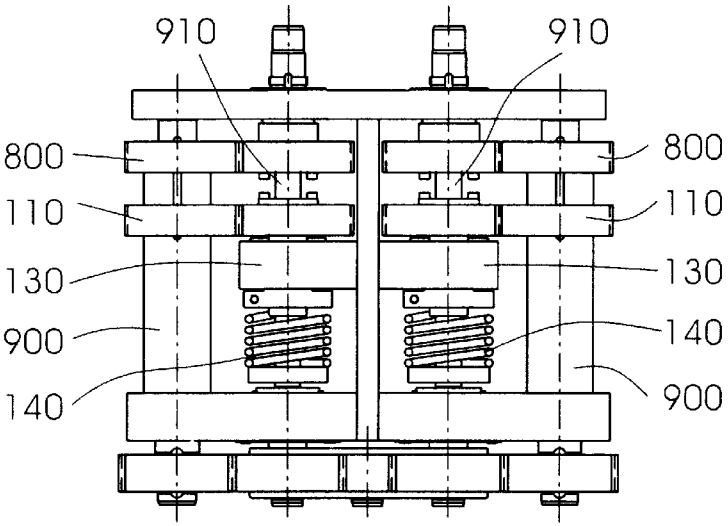
Figure 9D:
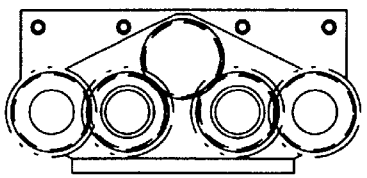

A third embodiment in accordance with the present invention which utilizes a belt to belt slow down device 100", is illustrated in FIGS. 8*a–h,* with the progression of the different length products through the device 100" shown for 8 positions over a complete cycle. The belt to belt device 100" is similar to the nip to belt device 100', except that the elliptical discs 4', 5' are replaced with aligned elliptical sprockets 4", 5" supporting timing belts 81. Similar to the discs 4', 5', the ellipse shaped portion of the sprockets 4", 5" provide clearance to allow the signature to advance into position with out being influenced by the belts 8 and 81 as they accelerate. The timing belts 81 and sprockets 4", 5" have the same pitch diameter as the lower sprockets 9.1, 9.2 and timing belts 8. In this manner, the signature is captured between a series of timing belts as it decelerates, thereby providing the added benefit of guiding the signature during deceleration. In addition, in accordance with this embodiment, there is no need to maintain a ¼ cutoff because the signature remains pinched between belts 8 and 81. In other words, the sprockets 4" and 5" can be separated by more than ¼ cutoff. In accordance with this embodiment, sprocket 4" is retractable to lift the belts 81 out of position to allow the incoming signature to enter the device 100" without any speed mismatch. As shown in FIGS. 8(*a–h*), the idler roller 6' is moveable between two positions depending upon the signature format, with the roller 6' in position 6.1 for digest fold signatures, and in position 6.2 for tabloid and delta fold signatures. In the particular embodiment shown in FIG. 8, the axes of sprockets 4", 5" are separated by 175 mm, and the axes of sprockets 9.1, 9.2 are separated by 275 mm. As shown in FIG. 8*d,* at ½ cycle, the idler roller 6', in its upstream position 6.1, will engage the first 20 mm of a leading edge of a digest format signature, and in its downstream position 6.2 will the first 20 mm of a leading edge of a delta format signature. As shown in FIG. 8*h,* at the start of the next cycle, the idler roller 90, will engage the last 20 mm of a trailing edge of a digest, delta, or tabloid fold signature, assuming trailing edge aligned products.

FIGS. 9(*a*) and 10 are the plan and elevation view respectively of an upper nip drive. FIGS. 9(*b*), 9(*c*), and 9(*d*) are perspective views of the drive of FIG. 9(*a*). The lower sprocket drive train is similar to the upper with the elliptical driver and driven gears inverted. Each of the devices 100, 100', and 100" can utilize the same type of drive mechanism. Referring to FIG. 9(*a*), slow down discs 4 (or discs 4', or sprockets 4") are driven by a first drive mechanism 400, and slow down discs 5 (or discs 5', or sprockets 5") are driven by a second drive mechanism 500, which is substantially identical in construction to first drive mechanism 400. In each drive mechanism (400 or 500) shown in FIGS. 9(*a–d*), speed variation is achieved with a primary elliptical gear pair 700, 800, and a secondary elliptical gear pair 109, 110. A drive shaft 900 rotates at a constant speed, with the driving elliptical gears 700, 109 imparting a variable speed output to the driven elliptical gears 700 and 109 respectively. Driven elliptical gears 700, 109 rotate about a drive train 910. The slow down discs 4, 5 (or discs 4', 5', or sprockets 4", 5") are directly coupled to the drive train 910 in order to minimize the inertia forces. Primary elliptical gear pair 700 and 800, as well as secondary elliptical gear pair 100, 110, engage a torsion spring 120. The torsion spring 120 is locked to a gear shaft 130 of secondary elliptical gear 110, and is wound at the collar 140 to pre-load both pairs of elliptical gears. The "uniflank" described above prevents the elliptical pair from coming out of mesh during the load reversal. Each slow down disc or sprocket set is preferably driven by a respective gear mechanism to avoid overloading the elliptical gear pairs.

Figure 10:
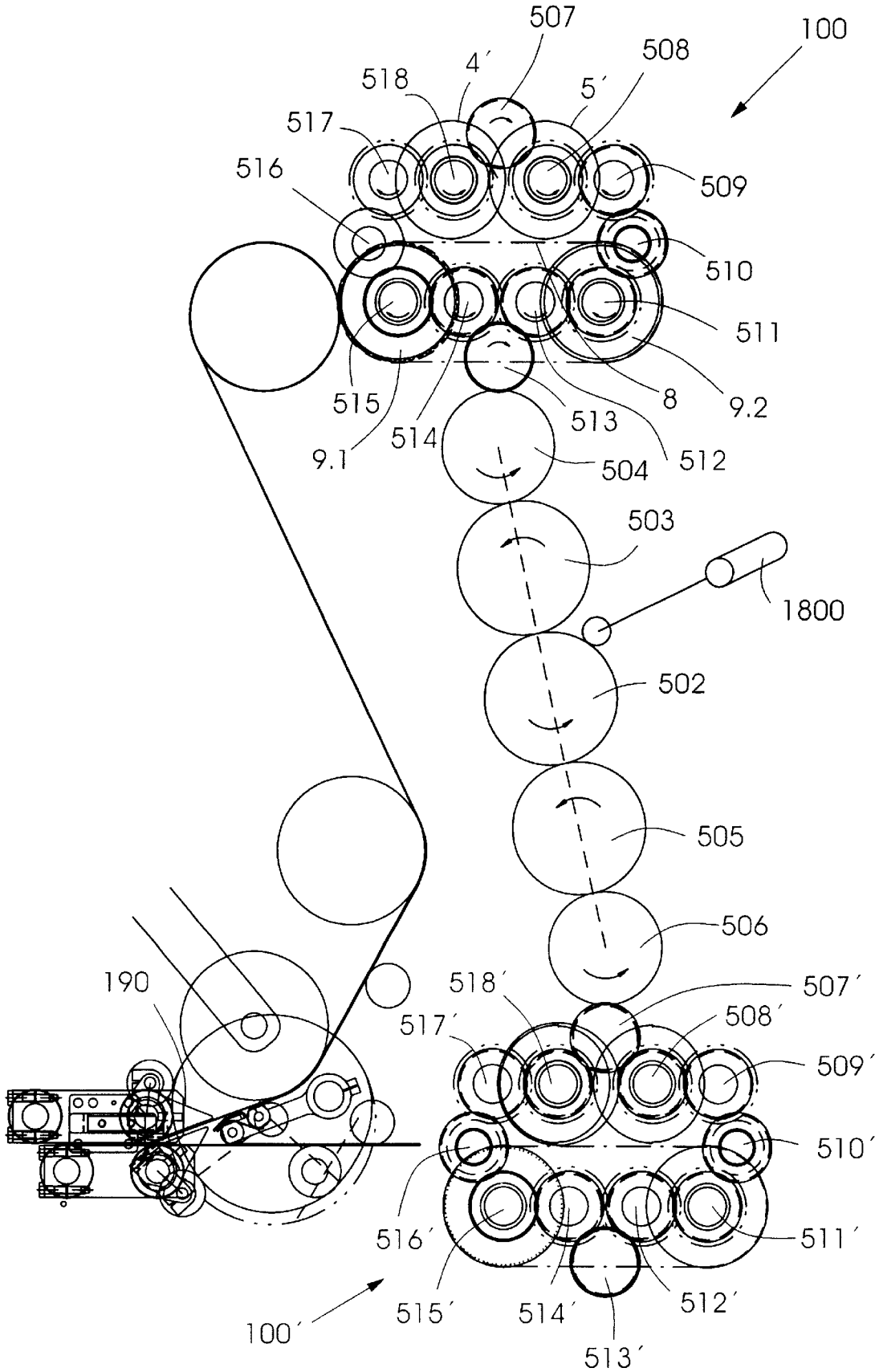
FIG. 10 is a side view of an assembly including upper and lower nip to belt slow down devices according to FIG. 7.

FIG. 10 is a side view of an upper and lower nip-to-belt slow down device 100' with associated drive mechanisms. The nip discs 4', 5' and timing belt sprockets 9.1, 9.2 will require different pitch diameters for different cutoffs. This change in pitch diameter requires the drive to be repositioned. To accommodate this, the two outside gears 510, 516 shift laterally to allow the change in height between the upper and lower bank of gears for the discs 4', 5' and sprockets 9.1, 9.2. Gear 507' of the lower slow down device provides the drive input to lower slowdown device, and gear 513 of the upper slow down device provides the drive input for the upper slow down device. A motor 1800 drives gears 507', 513 via in-line gears 502–506. Placing the main drive gear 502 between the upper and lower slow down devices minimizes the inertia forces at the drive input. Referring to FIG. 10, continuous products are diverted via diverting mechanism 190 upstream, such that alternating signatures are passed to the upper and lower slow down devices 100'. The upper transport therefore is phased 180 degrees with respect to the lower transport, with the net effect being to cancel the opposing inertia torque.

From drive input 513, the sprockets 9.1, 9.2, and discs 4', 5' of the upper slow down device are driven by gears 507–512, 514–518. Similarly, from drive input 507', the sprockets 9.1, 9.2, and discs 4', 5' of the lower slow down device are driven by gears 508'–518'.

Although elliptical gears are described above in FIGS. 9(*a,b*) for producing the variable speed profile of the slow down device, other mechanisms may also be used to provide the variable speed profile. For example, twin eccentric gears can be used to provide a similar velocity profile and can directly replace the elliptical gear pair in FIGS. 9(*a,b*). This is true for elliptical gears with the transmission ratio equal to 1.30 or less (which corresponds to the preferred transmission ratio for the devices of FIGS. 1, 6, 8). Moreover, other drive mechanisms may also be employed.

Figure 11:
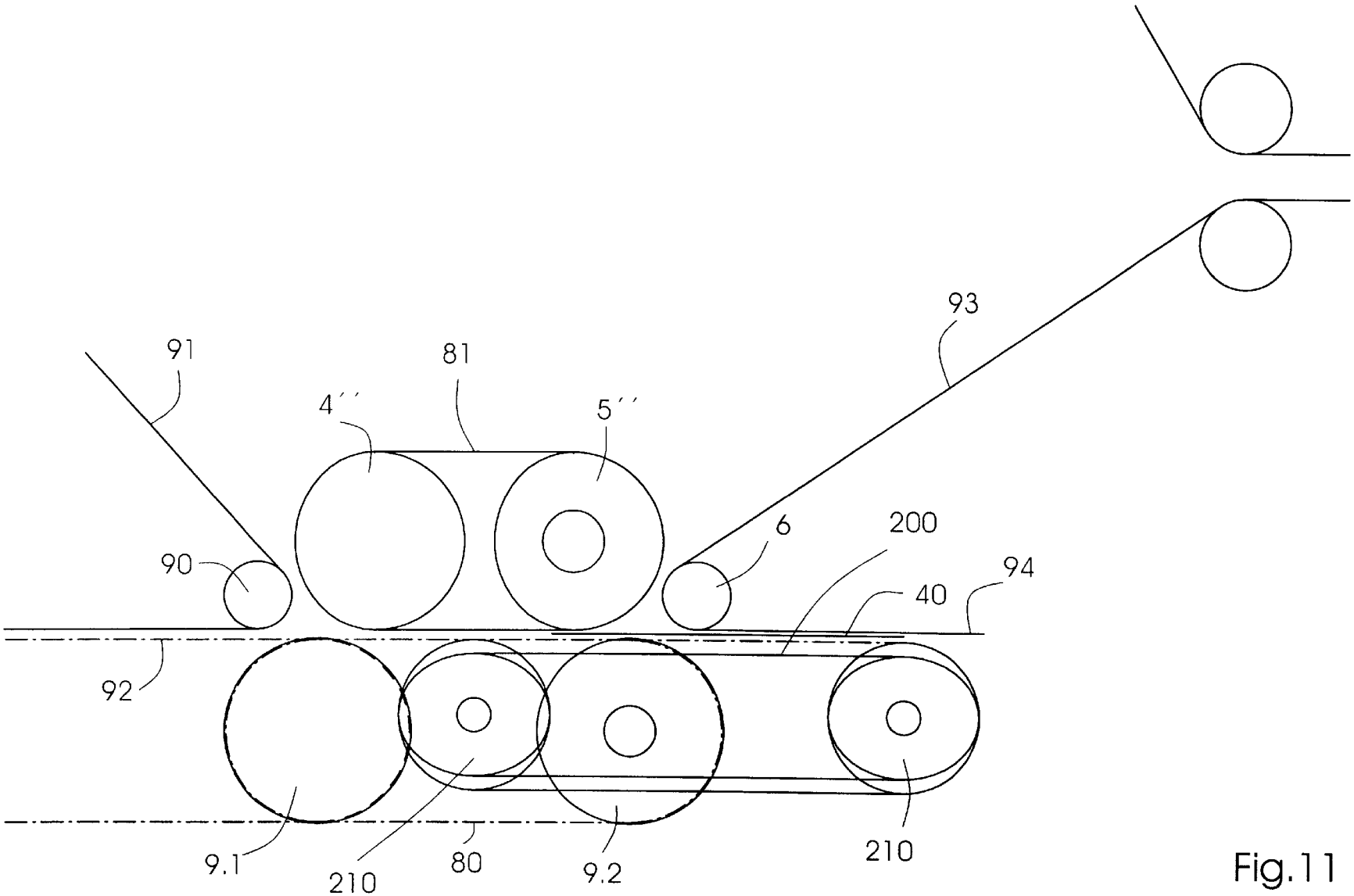
FIG. 11 is a side view of a belt to belt slow down device in accordance with FIGS. 8(*a–h*) and a retractable idler roller in accordance with another embodiment of the present invention.

FIG. 11 illustrates a mechanism for passing a signature from the slow down device 100" to the low speed exit belts 93, 94. In accordance with this embodiment, a fixed exit idler roller 6 and belts 93 is used in conjunction with a retracting low speed transport belt 200. Low speed transport belt 200 includes a pair of elliptically shaped retracing drive sprockets 210. FIG. 11 shows a time interval when the signature 40 has just completed the slowdown. The shortest product (digest) is 20 mm beyond the idler roller 6, and all other products, (delta, and tabloid) are well beyond the exit idler roller 6. However, in the position shown in FIG. 11, signatures are not nipped by the belts 200 because of the position of the elliptical sprockets 210. As the elliptical sprockets rotate, the belts 200 will rise to engage the exit idler roller 6. The sprockets 210 (and retracting belts 200) are driven at the same frequency as the sprockets 9.1, 9.2, 4", 5" of the device 100". However, the retracting belt is phased 180 degrees relative to the device 100". In this regard, the device 100" does not nip the signatures when the signature is being nipped between idler roller 6 and belts 200, and the idler roller 6 and belts 200 do not nip the signatures when the signature is being nipped by the device 100". Therefore the retracting belts 200 can not influence the speed of the signature as it decelerates, and the device 100" can not influence the speed of the signature as it exits under the control of the belts 200 and roller 6. Once again no operator or make ready is required for different paging or length signatures.

Figure 12A:
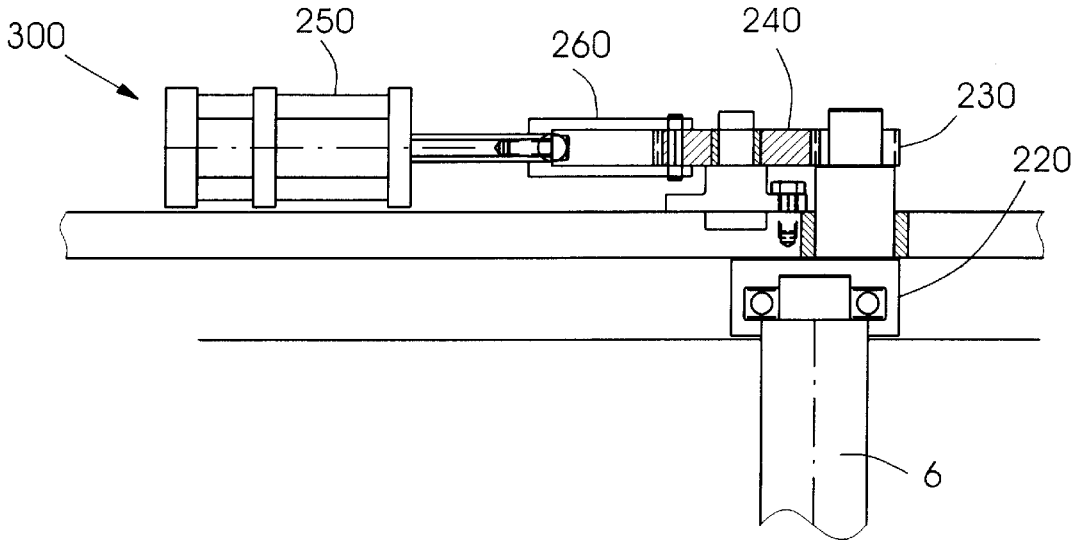
FIG. 12(*a*) is a top view of a portion of a pivoting idler roller in accordance with another embodiment of the invention.
Figure 12B:
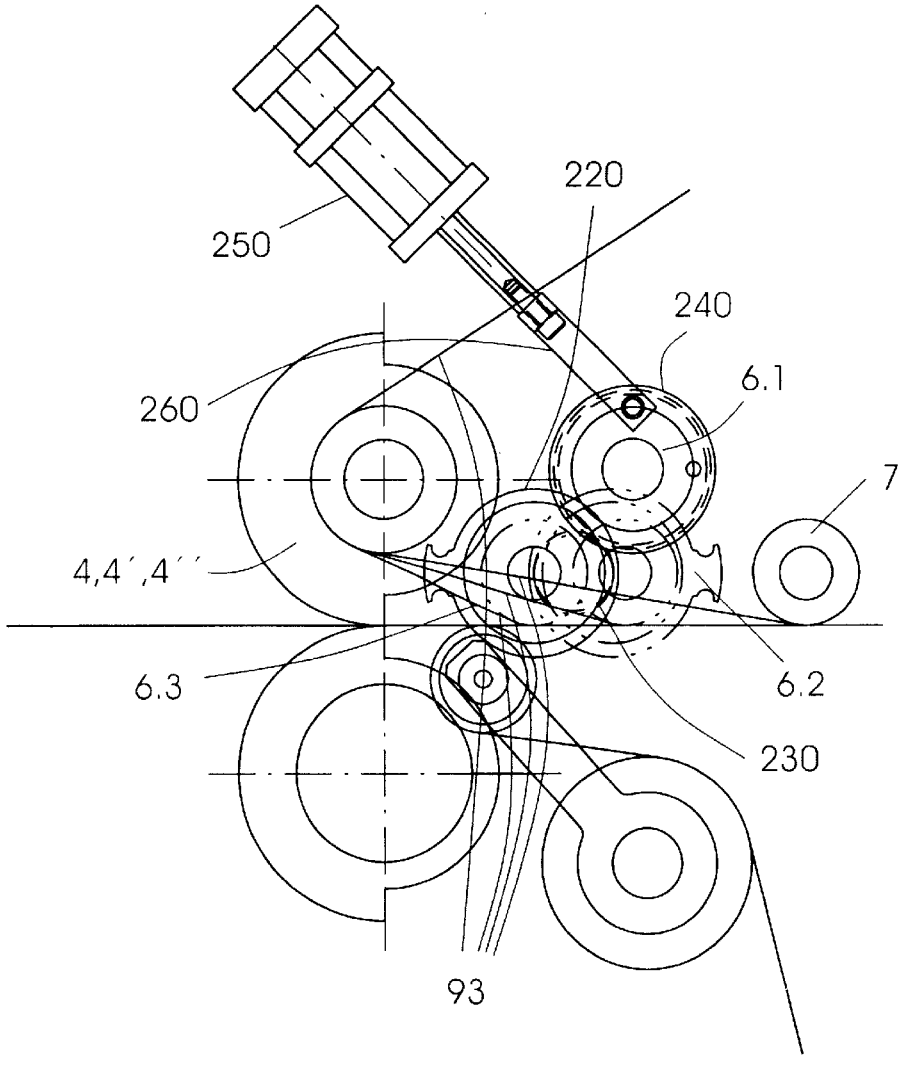

FIGS. 12(*a,b*) illustrate another mechanism for passing a signature from the slow down device 100" to the low speed belts 93, 94. A partial top and side view of a signature handoff mechanism 300 is shown in FIGS. 12(*a*) and 12(*b*) respectively. Referring to FIG. 12(*a*), exit idler roller 6 pivots on an eccentric 220. The eccentric 220 is configured to allow the idler roll 6 to occupy three distinct positions. This is accomplished via a 2:1 gear reduction via toothed gears 230, 240 connected to a three-position air cylinder 250 and link 260. The upper low speed transport belts 93, which are wound around the idler roller 6, will be repositioned to the position of the idler roller 6 as it pivots. The three positions in order are forward position 6.3 (for digest fold signatures), upward position 6.1 (for tabloid fold signatures), and rear position 6.2 ( for delta fold signatures). The rear idler 7 and corresponding belts (not shown) are fixed and are positioned to capture a tabloid fold by 20 mm (while the belt 93 is lifted away from the signature by idler roller 6). This feature allows automation of the exit idler roller 6.

While the embodiments of FIGS. 11 and 12 have been illustrated with reference to the belt to belt slow down device 100", these embodiments are equally applicable to the nip to nip slow down device 100 and the nip to belt slow down device 100'.

In accordance with another embodiment of the present invention, the double nip slow down devices (100, 100', and 100") in accordance with the present invention are situated upstream of the diverting mechanism, thereby reducing the number of parts per folder.

In accordance with yet another embodiment of the present invention, the retracting transport belts 270 and idler rollers) are provided before and after the double nip slow down device to prevent any buckling in the signature from velocity mismatches.

What is claimed is:

1. A signature slow down device comprising an entrance nip mechanism for receiving a signature from an upstream device at a first signature transport velocity and reducing the transport velocity of the signature to a first reduced transport velocity, the entrance nip mechanism having signature contacting surfaces defined by a pair of opposing non-circular rotating components, each non-circular rotating component having a first surface portion for forming a nip with its opposing non-circular rotating component and a second surface portion for forming a gap with its opposing non-circular rotating component, the opposing non-circular rotating components rotating at a variable velocity profile in which the non-circular rotating components decelerate when the nip is formed by the entrance nip mechanism, and accelerate when the gap is formed by the entrance nip mechanism; and an exit nip mechanism for receiving the signature from the entrance nip mechanism, and further reducing the transport velocity of the signature to a second reduced transport velocity, the exit nip mechanism having signature contacting surfaces defined by a pair of opposing non-circular rotating components, each non-circular rotating component having a first surface portion for forming a nip with its opposing non-circular rotating component and a second surface portion for forming a gap with its opposing non-circular rotating component; the opposing non-circular rotating components rotating at a variable velocity profile in which the non-circular rotating components decelerate when the nip is formed by the exit nip mechanism, and accelerate when the gap is formed by the exit nip mechanism.

2. The device of claim 1, wherein the opposing non-circular rotating components of the entrance nip mechanism include a pair of opposing cylinders, and each cylinder includes a first arc length having a first radius sufficient to form a nip between the opposing cylinders, each cylinder including a second arc length having one or more second radii, the second radii being smaller than the first radius, the second radii being sufficient to form a gap between the opposing cylinders; and wherein the opposing non-circular rotating components of the exit nip mechanism include a pair of opposing cylinders, and each cylinder includes a first arc length having a first radius sufficient to form a nip between the opposing cylinders, each cylinder including a second arc length having one or more second radii, the second radii being smaller than the first radius, the second radii being sufficient to form a gap between the opposing cylinders.

3. The device of claim 2, wherein the first arc length is circular in shape and the second arc length is elliptical in shape.

4. The device of claim 2, wherein at least one cylinder of each of the entrance nip mechanism and the exit nip mechanism includes a plurality of axially spaced apart discs.

5. The device of claim 2, wherein the opposing cylinders of the entrance nip mechanism are spaced apart from the opposing cylinders of the exit nip mechanism by ¼ of a cutoff of a tabloid fold signature.

6. The device of claim 2, wherein the opposing cylinders of the entrance nip mechanism are spaced apart from the opposing cylinders of the exit nip mechanism by less than ¼ of a cutoff of a tabloid fold signature.

7. The device of claim 1, wherein the opposing non-circular rotating components of the entrance nip mechanism include an entrance nip cylinder and a first rotating belt supporting element having a belt mounted thereon, the entrance nip cylinder including a first arc length having a first radius and a second arc length having one or more second radii, the first rotating belt supporting element having a pitch radius over a first arc length equal to the first radius, and one or more second pitch radii over a second arc length equal to the one or more second radii, the second radii being smaller than the first radius, the first radius being sufficient to form a nip between the entrance cylinder and the belt, the second radii being sufficient to form a gap between the entrance nip cylinder and the first rotating belt supporting mechanism; and wherein the opposing non-circular rotating components of the exit nip mechanism include an exit nip cylinder and a second rotating belt supporting element having a belt mounted thereon, the exit nip cylinder including a first arc length having the first radius and a second arc length having the one or more second radii, the second rotating belt supporting element having a pitch radius over a first arc length equal to the first radius, and one or more second pitch radii over a second arc length equal to the one or more second radii.

8. The device of claim 7, wherein the entrance nip cylinder is spaced apart from the exit nip cylinder by ¼ of a cutoff of a tabloid fold signature.

9. The device of claim 7, wherein the entrance nip cylinder is spaced apart from the exit nip cylinder by less than ¼ of a cutoff of a tabloid fold signature.

10. The device of claim 7, wherein the first and second rotating belt supporting mechanisms straddle the entrance and exit nip cylinders such that the entrance nip cylinder and the first rotating belt supporting mechanism form a first S-shaped nip, and the exit nip cylinder and the second rotating belt supporting mechanism form a second S-shaped nip.

11. The device of claim 7, wherein the at least one belt is mounted on both the first rotating belt supporting mechanism and the second rotating belt supporting mechanism.

12. The device of claim 7, wherein the first arc lengths of the entrance nip cylinder, exit nip cylinder, first rotating belt supporting mechanism, and second rotating belt supporting mechanism are circular in shape and the second arc length of the entrance nip cylinder, exit nip cylinder, first rotating belt supporting mechanism, and second rotating belt supporting mechanism are elliptical in shape.

13. The device of claim 7, wherein the first and second rotating belt supporting elements are sprockets.

14. The device of claim 7, wherein the first and second rotating belt supporting elements are pulleys.

15. The device of claim 7, wherein the first radius of the entrance nip cylinder is equal to the first radius of the exit nip cylinder.

16. The device of claim 1, wherein the opposing non-circular rotating components of the entrance nip mechanism include opposing first and second rotating belt supporting elements each having a respective first and second belt mounted thereon, the first and second rotating belt supporting elements each having a first pitch radius over a first arc length, and one or more second pitch radii over a second arc length, the second pitch radii being smaller than the pitch first radius, the first pitch radius being sufficient to form a nip between the first and second rotating belt supporting elements, the second radii being sufficient to form a gap between the first and second rotating belt supporting elements; and wherein the opposing non-circular rotating components of the exit nip mechanism include opposing third and fourth rotating belt supporting element having a respective one of the first and second belts mounted thereon, the third and fourth rotating belt supporting elements each having the first pitch radius over a respective first arc length, and the one or more second pitch radii over a respective second arc length.

17. The device of claim 16, wherein the first arc lengths of the first, second, third and fourth rotating belt supporting mechanisms are circular in shape and the second arc lengths of the first, second, third and fourth rotating belt supporting mechanisms are elliptical in shape.

18. The device of claim 16, wherein the first, second, third and fourth rotating belt supporting elements are sprockets.

19. The device of claim 16, wherein the first, second, third, and fourth rotating belt supporting elements are pulleys.

20. The device of claim 1, wherein the first surface portion is circular in shape, and the second surface portion is of any shape.

21. The device of claim 15, wherein the first rotating belt supporting element is spaced apart from the third rotating belt supporting element by more than ¼ of a cutoff of a tabloid fold signature.

* * * * *